US005281251A

United States Patent [19]

Kenny et al.

[11] Patent Number: 5,281,251

[45] Date of Patent: Jan. 25, 1994

[54] PROCESS FOR SHAPE CASTING OF PARTICLE STABILIZED METAL FOAM

[75] Inventors: Lorne D. Kenny, Inverary; Martin Thomas, Kingston, both of Canada

[73] Assignee: Alcan International Limited, Montreal, Canada

[21] Appl. No.: 971,307

[22] Filed: Nov. 4, 1992

[51] Int. Cl.[5] ..... B22D 27/00

[52] U.S. Cl. ..... 75/415; 164/79

[58] Field of Search ..... 164/79; 75/415

[56] References Cited

U.S. PATENT DOCUMENTS

| | | | |
|---|---|---|---|
| 3,595,059 | 7/1971 | Erb | 72/362 |
| 3,873,392 | 3/1975 | Niebylski et al. | 156/306 |
| 3,994,648 | 11/1976 | Kornylak et al. | 425/150 |
| 4,973,358 | 11/1990 | Jin et al. | 75/415 |

FOREIGN PATENT DOCUMENTS

| | | | |
|---|---|---|---|
| 615147 | 12/1926 | France | 75/415 |

*Primary Examiner*—Melvyn J. Andrews
*Attorney, Agent, or Firm*—Cooper & Dunham

[57] ABSTRACT

Shaped articles are produced from foam metal by a procedure wherein the foam is formed by heating a composite of a metal matrix and finely divided solid stabilizer particles above the solidus temperature of the metal matrix and discharging gas bubbles into the molten metal composite below the surface thereof thereby form a stabilized liquid foam on the surface of the molten metal composite. According to the novel feature the stabilized metal foam in liquid form is shape cast by being pressed into a mould and permitted to cool and solidify. The density of the cast part is essentially unchanged from that of the starting liquid foam.

13 Claims, 5 Drawing Sheets

ML-21031 4X

ML-21032 100X 92-75 IX

PROCESS FOR SHAPE CASTING OF PARTICLE STABILIZED METAL FOAM

TECHNICAL FIELD

This invention relates to a process and apparatus for shape casting particle stabilized metal foam, particularly particle stabilized aluminum foam.

BACKGROUND OF THE INVENTION

Lightweight metal foams have high strength-to-weight ratios and are extremely useful as load-bearing materials and as thermal insulators. Metal foams are characterized by high impact energy absorption capacity, low thermal conductivity, good electrical conductivity and high absorptive acoustic properties.

A particle stabilized metal foam of exceptional stability is described in Jin et al U.S. Pat. No. 4,973,358, issued Nov. 27, 1990. According to that patent, a composite of a metal matrix and finely divided solid stabilizer particles is heated above the liquidus temperature of the metal matrix. Gas is then introduced into the molten metal composite below the surface of the composite to form bubbles therein. These bubbles float to the top surface of the composite to produce on the surface a closed cell foam. The foam which forms on the surface of the molten metal composite is a highly stable liquid foam, i.e. the foam cells do not collapse under their own weight. This stable liquid foam is then cooled below the liquidus temperature of the melt to form a metal foam product having a plurality of closed cells and the stabilizer particles dispersed within the metal matrix.

A method for shaping metal foam is described in Niebylski et al, U.S. Pat. No. 3,873,392, issued Mar. 25, 1975, in which solid metal foam is compressed such that cell walls are crushed. Although heat may be used, it is preferred that the temperature does not exceed about 38° C. below the melting point of the base metal.

Another method for shaping a metal foam body is described in Erb, U.S. Pat. No. 3,595,059, issued Jul. 27, 1971. In this method, the forming device is reciprocated causing localized heating and crushing of the walls of the foam structure.

Shape casting of molten metals, such as aluminum, can be carried out in a wide variety of closed moulds. One such technique is squeeze casting, also known as liquid-metal forging, in which molten metal solidifies under pressure within closed dies positioned between the plates of a hydraulic press. The applied pressure and the instant contact of the molten metal with the die surface produces a rapid heat transfer condition that yields a pore-free fine-grain casting with mechanical properties approaching those of a wrought product. Semi-solid metal working is also used, which incorporates elements of both casting and forging. This may be referred to as rheocasting, thixocasting or stir casting. In this procedure a thixotropic material is formed which can be moved and handled.

It is the object of the present invention to provide a shape casting technique for particle stabilized metal foam which takes advantage of the unique characteristics of the particle stabilized metal foam.

SUMMARY OF THE INVENTION

In the present invention, a composite of a metal matrix, e.g. aluminum alloy, and finely divided solid stabilizer particles is heated above the solidus temperature of the metal matrix. Gas is then introduced into the molten metal composite below the surface of the composite to form bubbles therein and these bubbles float to the surface of the composite to produce on the surface a closed cell metal foam. The metal foam which forms on the surface of the molten metal composite is stabilized by the presence of the particles and this stabilized liquid foam has considerable structural integrity.

In one embodiment of this invention, the stabilized liquid foam is continuously drawn off from the surface of the molten metal composite and is thereafter cast into a shaped, solidified metal foam article. The shape casting is done while the foam is in the liquid form either immediately after foam generation or by reheating a previously cast slab of liquid foam to temperatures above the solidus temperature.

The shape casting can be done by a variety of techniques, such as squeeze casting, etc. Since the foam is in the liquid or liquid+solid state, the pressure required to deform the foam is low. Cells do not collapse under pressure since within the mould the cells are under a state of hydrostatic stress. Thus, density of the formed part is essentially unchanged from that of the starting foam material. The formed article exhibits a continuous skin due to the metal flow during the shaping operation.

The term "shape casting" as used in the present invention means that the liquid foam is gently pressed into a mould sufficient only to cause the liquid foam to assume the shape of the mould without compressing and/or collapsing the cells of the foam. It is also possible to subject the foam to "shape forming" in which the foam within the mould is subjected to further deformation. This shape forming can be done when the metal foam is in the liquid or liquid/solid state and it can be done with or without densification of the foam. For instance, foam outside the mould proper, e.g. a flange, may be compressed resulting in densification of the foam in that area. It is also possible to press a shape forming tool into the foam in a mould to further modify the shape of the article being cast without densifying it. An important advantage of the processes of the present invention is that parts can be made to net or near net shapes, thereby avoiding machining.

The success of the forming method is highly dependent upon the nature and amount of the finely divided solid refractory stabilizer particles. A variety of such refractory materials may be used which are particulate and which are capable of being incorporated in and distributed through the metal matrix and which at least substantially maintain their integrity as incorporated rather than losing their form or identity by dissolution in or chemical combination with the metal.

Examples of suitable solid stabilizer materials include alumina, titanium diboride, zirconia, silicon carbide, silicon nitride, magnesium oxide, etc. The volume fraction of particles in the foam is typically less than 25% and is preferably in the range of about 5 to 15%. The particle sizes can range quite widely, e.g. from about 0.1 to 100 μm, but generally particle sizes will be in the range of about 0.5 to 25 μm with a particle size range of about 1 to 20 μm being preferred.

The particles are preferably substantially equiaxial. Thus, they preferably have an aspect ratio (ratio of maximum length to maximum cross-sectional dimension) of no more than 2:1. There is also a relationship between particle sizes and the volume fraction that can be used, with the preferred volume fraction increasing with increasing particle sizes. If the particle sizes are too small, mixing becomes very difficult, while if the particles are too large, particle settling becomes a significant problem. If the volume fraction of particles is too low, the foam stability is then too weak and if the particle volume fraction is too high, the viscosity becomes too high.

The metal matrix may consist of any metal which is capable of being foamed. Examples of these include aluminum, steel, zinc, lead, nickel, magnesium, copper and alloys thereof.

The foam-forming gas may be selected from the group consisting of air, carbon dioxide, oxygen, water, inert gases, etc. Because of its ready availability, air is usually preferred. The gas can be injected into the molten metal composite by a variety of means which provide sufficient gas discharge pressure, flow and distribution to cause the formation of a foam on the surface of the molten composite. Preferably, a strong shearing action is imparted to a stream of gas entering the molten composite, thereby breaking up the injected gas stream into a series of bubbles. This can be done in a number of ways, including injecting the gas through a rotating impeller, or through a vibrating or reciprocating nozzle. It is also possible to inject the gas within an ultrasonic horn submerged in the molten composite, with the vibrating action of the ultrasonic horn breaking up the injected gas stream into a series of bubbles. The cell size of the foam can be controlled by adjusting the gas flow rate, as well as the impeller design and rotational speed where used or the amplitude and frequency of oscillation or vibration where an oscillating or vibrating system is used.

In forming the foam according to this invention, the majority of the stabilizer particles adhere to the gas-liquid interface of the foam. This occurs because the total surface energy of this state is lower than the surface energy of the separate liquid-gas and liquid-solid state. The presence of the particles on the bubbles tends to stabilize the froth formed on the liquid surface. It is believed that this may happen because the drainage of the liquid metal between the bubbles in the froth is restricted by the layer of solids at the liquid-gas interfaces. The result is a liquid metal foam which is not only stable, but also one having uniform pore or cell sizes throughout the foam body since the bubbles tend not to collapse or coalesce.

The pores or cells of the foam may be as large as 50 mm, provided they are uniform in size. However, small uniform cell sizes averaging less than 5 mm are preferred. The small cell sizes have the advantage of easily moving or deforming during shaping to fill the mould. With larger cells, on the other hand, shearing or tearing of the cell walls may occur when complex shapes are made.

In a preferred embodiment of the present invention, a layer of stabilized liquid foam is drawn off a foam generating box and this freshly generated foam layer is pressed by a platen down into a preheated mould. The formed article exhibits a continuous outer skin due to metal flow during the shaping operation.

In another preferred embodiment, a previously cast slab of stabilized metal foam is heated to temperatures above the solidus and this reheated slab is again pressed down into a preheated mould by means of a platen to form a shaped article with a continuous outer skin. This provides a more rigid area for attachment of the shaped part to other structures.

In another preferred embodiment of the invention, it is possible to draw the freshly formed stabilized metal foam away from the foam generating box on a conveyor belt, e.g. a steel belt, and an inverted mould is pressed downwardly from above into the foam travelling on the belt. This is capable of forming a shaped article in the same manner as the previously described platen pressing the foam downwardly into a mould.

In other embodiments utilizing a continuous belt, a series of individual moulds may be mounted on a conveyor belt and these individual moulds pick up stabilized foam emerging from a foam generating box, with the foam being pressed into the travelling moulds by means of platens. Alternatively, a continuous profiled slab of foam may be formed while travelling on a conveyor belt by means of profiled rolls engaging the slab.

BRIEF DESCRIPTION OF THE DRAWINGS

In the drawings which illustrate the present invention.

DESCRIPTION OF THE PREFERRED EMBODIMENTS

Figure 1:
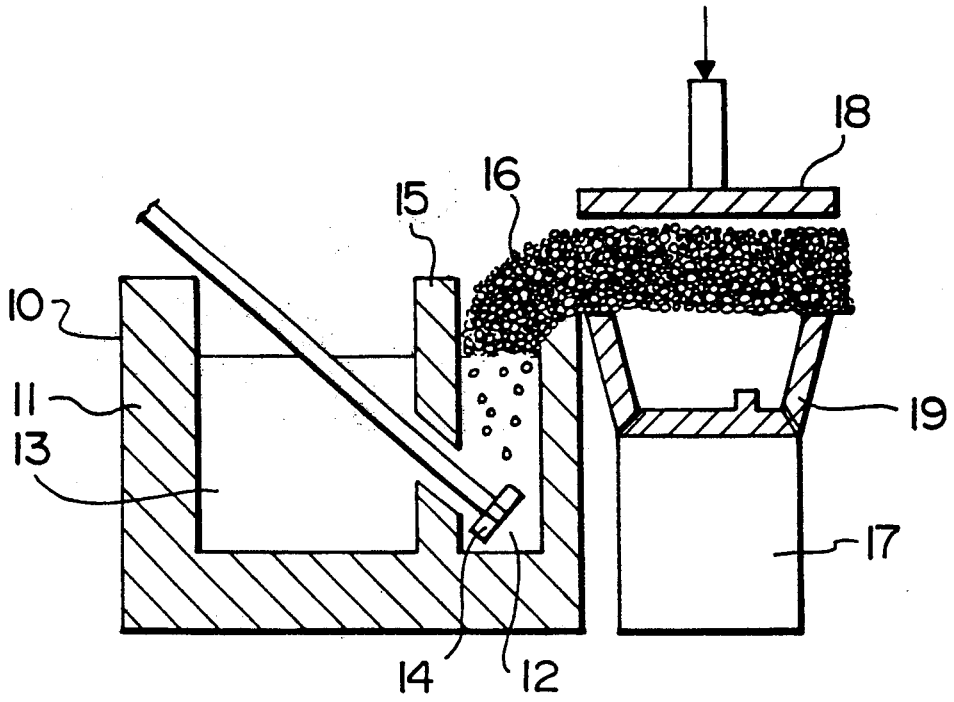
FIG. 1 is a sectional view of a metal foam generating box and mould for, forming shaped parts.

As seen in FIG. 1, a metal foam generator 10 comprises a vessel 11 having a divider wall 15 extending between side walls to form a foaming chamber 12 and a holding chamber 13. The holding chamber 13 holds a composite of molten metal matrix and finely divided solid stabilizer particles. Fresh composite is added to chamber 13 as needed. An air injecting impeller 14 with air discharge holes in the impeller extends into the foaming chamber 12 and the mixing action of the impeller with the injection of air therethrough creates foam 16 which rises from the surface of the molten metal composite in the foaming chamber 12. A typical foam is made from Al - 9 Si - 0.8 Mg - 15 SiC composite alloy with small average foam cell size of less than about 5 mm.

Because of the strong and resilient nature of the stabilized liquid foam produced from the composite in the foaming chamber, this foam can be simply drawn off from the surface of the foaming chamber 12.

Figure 2:
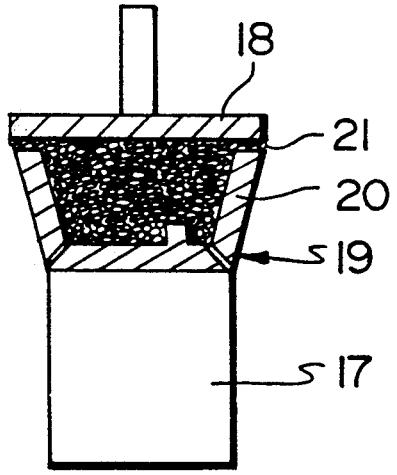
FIG. 2 is a sectional view of the mould of FIG. 1 with the part formed.

The freshly formed stabilized liquid foam 16 was drawn above a preheated mould 19 mounted on a support 17. A platen 18 moved downwardly, pushing the foam 16 into the mould 19 to form a shaped article as shown in FIG. 2 with a densified flange area 21.

Figure 3:
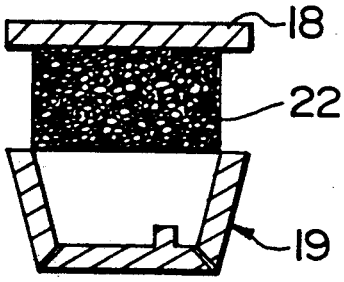
FIG. 3 is a sectional view of a mould for moulding precast and reheated foam.
Figure 4:
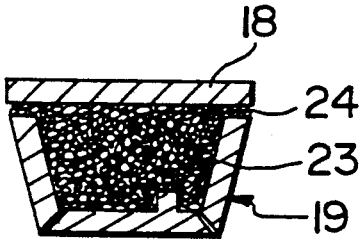
FIG. 4 is a sectional view of the mould of FIG. 3 with the part formed.

FIGS. 3 and 4 show an alternative embodiment in which a metal foam block 22 was positioned above mould 19. This preform was preheated to above the liquidus temperature of the metal, i.e. 650° C., before being placed over the mould and the mould was also preheated, to about 300° C. The platen 18 was then moved downwardly, compressing the pre[illegible]n 22 into the mould 19 to form a slotted brick shape 23 as shown in FIG. 4. A densified flange area 24 was formed at the periphery of the shaped part. The flange is denser, (consisting of flattened cells) and as such provides a more rigid area for attachment of the shaped part to other structures. For example, holes may be drilled in the flange and bolts or screws inserted through to an underlying structure.

Figure 5:
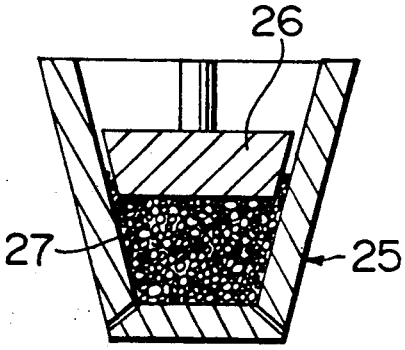
FIG. 5 is a sectional view of a mould forming a bowl-shaped part in a first stage.
Figure 6:
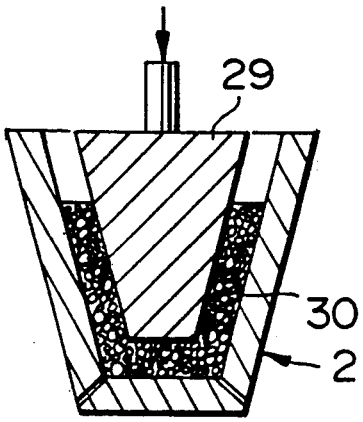
FIG. 6 is a sectional view of the mould of FIG. 5 in a second stage.

A bowl-shaped article may be formed using the mould system of FIGS. 5 and 6. Stabilized liquid foam 27 was placed in the bottom of a graphite bowl-shaped mould 25 and a refractory platen 26 was used to compress and form the exterior surface. The platen 26 was then replaced by a conical shaped platen 29 also formed of graphite which was pressed into the foam to shape form the interior wall of the bowl-shaped final article 30.

Figure 7:
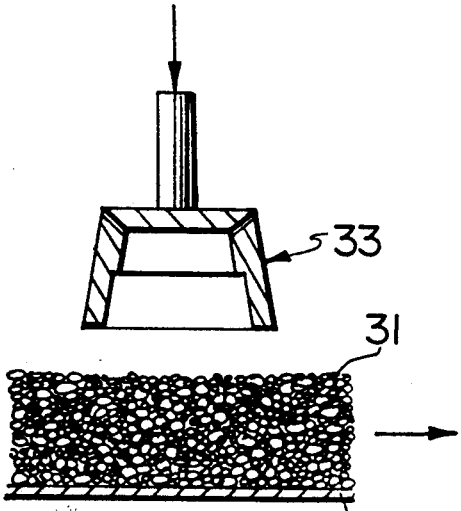
FIG. 7 is a sectional view showing a system for moulding a part from foam travelling on a conveyor belt.
Figure 8:
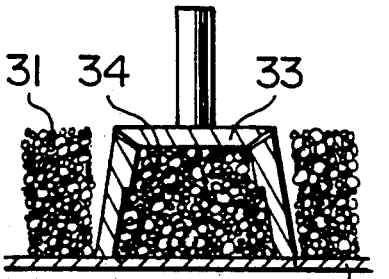
FIG. 8 is a sectional view of the system of FIG. 7 with the part formed.

FIGS. 7 and 8 show an arrangement in which stabilized liquid foam 31 was carried on a steel conveyor belt 32. An inverted cylindrical steel mould 33 was pressed downwardly into the foam 31 as shown in FIG. 8 to create a shaped foam article 34.

Figure 9:
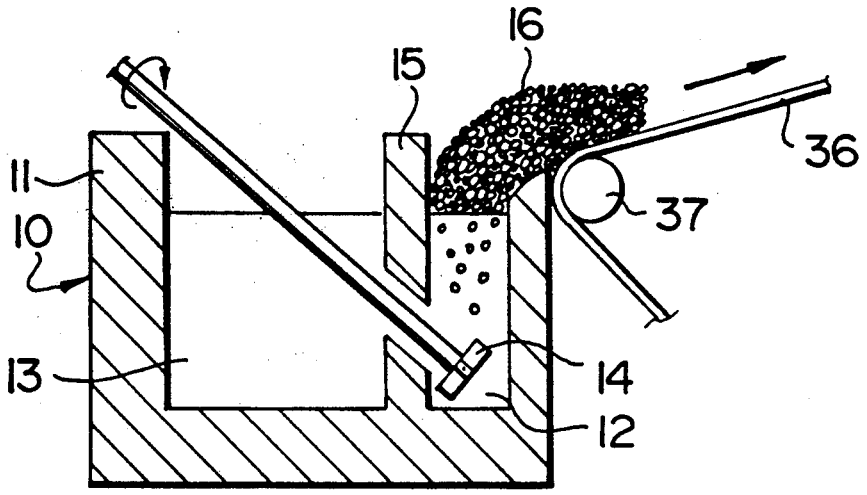
FIG. 9 is a diagrammatic sectional view of a foam generating box and conveyor belt.

FIG. 9 shows the identical foam generator as described in FIG. 1, but in this case the foam 16 which was generated was drawn off onto steel conveyor belt 36 which is carried by drive rolls 37. Typical conditions for producing a metal foam with cells of less than about 3 mm are as follows:

| | |
|---|---|
| Alloy: | A356 + 15% SiC |
| Melt Temp.: | 720° C.-630° C. |
| Casting Speed: | 12 cm/minute |
| Air Flow Rate (nominal): | .3 l/minute |
| Impeller Speed: | 1050 rpm |
| Slab Dimensions (approx.): | 5 cm thick × 17 cm wide × 150 cm long |

Figure 10:
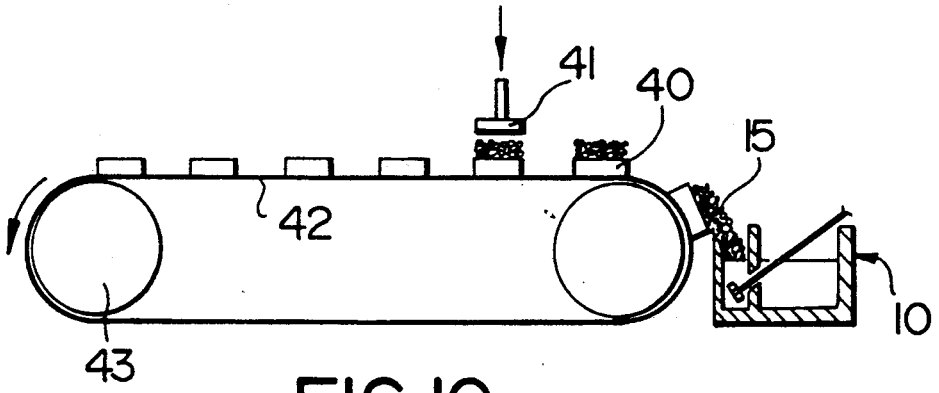
FIG. 10 is a diagrammatic sectional view of a conveyor belt carrying individual moulds.
Figure 11:
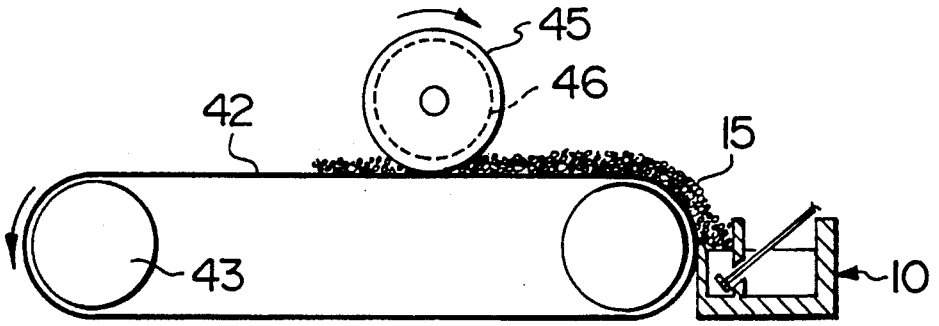
FIG. 11 is a diagrammatic sectional view of a conveyor system for forming a continuous profiled foam strip.

Alternative forms of conveyor belts are shown in FIGS. 10 and 11, with FIG. 10 showing a series of separate moulds 40 mounted in spaced relationship on a conveyor belt 42 travelling on drive rolls 43. As the moulds 40 move past the foam generator 10 they pick up foam as shown and the foam is pressed down into the moulds 40 by means of platen 41 in the same manner as described in FIGS. 1 and 2.

It is also possible according to the present invention to create a continuous profiled strip of foam and this is described in FIG. 11. In this case, a steel belt 42 and drive rolls 43 are again used, but a continuous layer of foam 15 is drawn from the foam generator 10 and this continuous layer 15 of foam is then compressed by means of roll 45 with a profiled shape 46.

Figure 12:
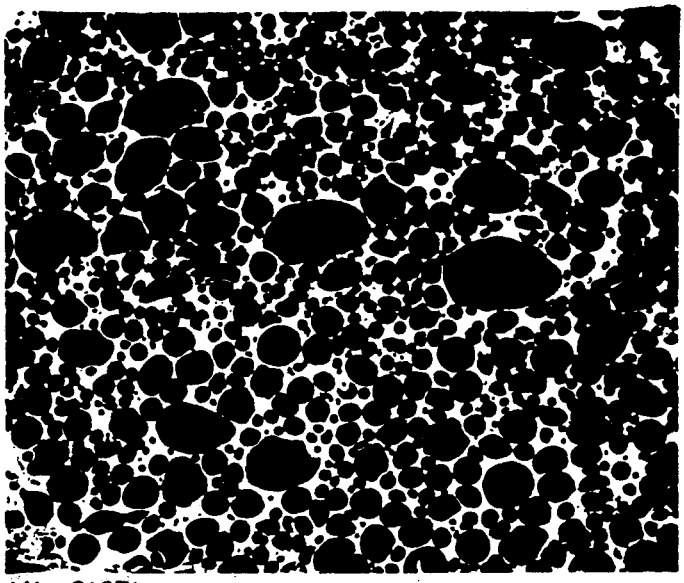
FIG. 12 is a photomicrograph of typical metal foam used for the invention.
Figure 13:
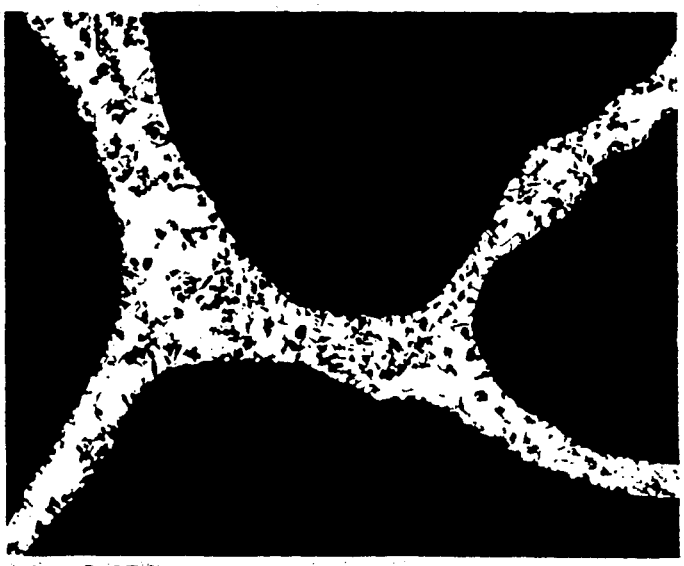
FIG. 13 is a further enlarged photomicrograph showing details of the foam cells.

The nature of the foam is illustrated by FIGS. 12 and 13 with FIG. 12 being a 4x magnification and FIG. 13 being a 100x magnification. Particularly FIG. 13 shows the structure of the walls between the cells lined by stabilizing particles. The foam which is used has an average cell size in the range of 2-3 mm.

Figure 14:
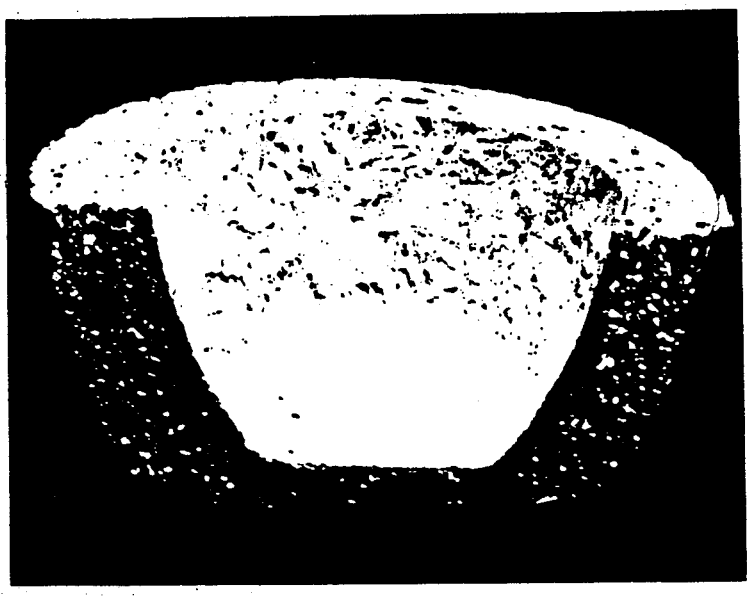
FIG. 14 is a photograph of a bowl-shaped part with a portion cut away.

A metal foam bowl produced by the technique of FIGS. 5 and 6 is shown in the photograph of FIG. 14. This photograph is of a bowl formed of particle stabilized aluminum foam which has been cut to expose the structure. It will be seen that dense layers were formed at the surfaces, but there was no breakdown of the foam structure itself.

Figure 15:
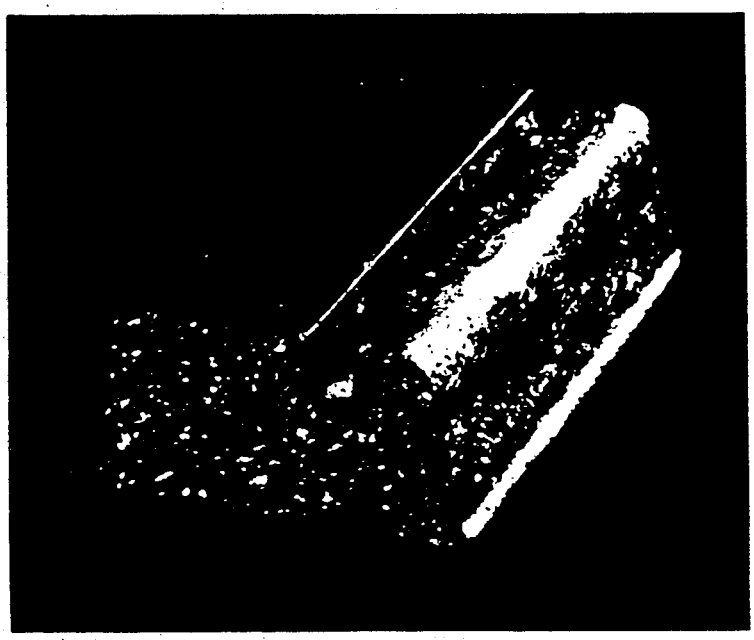
FIG. 15 is a photograph of a slice through a profiled part.

The product formed by the system of FIGS. 1 and 2 is shown in FIG. 15. Again, the dense outer surface can be seen and it could also be seen that the interior foam structure remained essentially unchanged.

While preferred embodiments of the present invention have been described in detail for the advantages of the specific details and for purposes of illustration, further modifications, embodiments and variations are contemplated according to the broader aspects of the present invention, all as determined by the spirit and scope of the following claims.

We claim:

1. A process for producing shaped articles of foam metal which comprises providing a stabilized liquid foam metal formed by heating a composite of a metal matrix and finely divided solid stabilizer particles above the solidus temperature of the metal matrix and discharging gas bubbles into the molten metal composite below the surface thereof to thereby form a stabilized liquid foam on the surface of the molten metal composite, shape casting said stabilized liquid foam metal by gently pressing the stabilized liquid foam into a mould with a pressure sufficient only to cause the liquid foam to assume the shape of the mould without substantial compressing and/or collapsing of the cells of the foam and thereafter cooling and solidifying the foam in the mould to obtain a shaped article having substantially the same density as the starting stabilized liquid foam metal.

2. A process as claimed in claim 1 wherein the stabilized liquid foam is a freshly generated foam.

3. A process as claimed in claim 1 wherein the stabilized liquid foam is a previously cast stabilized metal foam which has been heated to a temperature above the solidus temperature.

4. A process as claimed in claim 1 wherein the mould is preheated before the stabilized liquid foam is pressed therein.

5. A process as claimed in claim 1 wherein the metal is an aluminum alloy.

6. A process as claimed in claim 5 wherein the stabilized liquid foam is pressed into the mould by means of a movable platen.

7. A process as claimed in claim 6 wherein a first movable platen presses the stabilized liquid foam into the mould and forms smooth exterior surfaces on a shaped foam article and a second platen is pressed into the stabilized liquid foam within the mould to form smooth interior surfaces on a shaped foam article.

8. A process as claimed in claim 5 wherein the stabilized liquid foam is carried on a moving belt and a vertically reciprocating inverted mould is pressed downwardly into the stabilized liquid foam on the belt to thereby form a shaped foam article.

9. A process as claimed in claim 5 wherein a plurality of moulds mounted on a conveyor belt pick up stabilized liquid foam from a foam generator and the foam picked up by each mould is pressed into the mould by means of a reciprocating platen.

10. A process as claimed in claim 5 wherein the stabilized liquid foam has cells of uniform size.

11. A process as claimed in claim 10 wherein cells of the stabilized liquid foam have uniform average sizes of less than 5 mm.

12. A process as claimed in claim 1 wherein the shape casting is squeeze casting.

13. A process as claimed in claim 1 wherein the shape casting operation is followed by a shape forming operation.

* * * * *